US007348120B2

(12) United States Patent
Eida et al.

(10) Patent No.: US 7,348,120 B2
(45) Date of Patent: Mar. 25, 2008

(54) TONER FOR ELECTROSTATIC IMAGE DEVELOPMENT

(75) Inventors: Akihiro Eida, Wakayama (JP); Jun Shimizu, Wakayama (JP)

(73) Assignee: Kao Corporation, Tokyo (JP)

( * ) Notice: Subject to any disclaimer, the term of this patent is extended or adjusted under 35 U.S.C. 154(b) by 505 days.

(21) Appl. No.: 11/102,718

(22) Filed: Apr. 11, 2005

(65) Prior Publication Data

US 2005/0233236 A1 Oct. 20, 2005

(30) Foreign Application Priority Data

Apr. 15, 2004 (JP) ..... 2004-120852

(51) Int. Cl.
*G03G 9/08* (2006.01)

(52) U.S. Cl. ..... 430/108.7; 430/108.1; 430/137.2

(58) Field of Classification Search ..... 430/108.7, 430/108.1, 137.2
See application file for complete search history.

(56) References Cited

U.S. PATENT DOCUMENTS 6,171,744 B1 * 1/2001 Nakazawa et al. ..... 430/108.6
6,875,550 B2 * 4/2005 Miyakawa et al. ..... 430/108.6
2003/0186153 A1 10/2003 Ishihara et al.

FOREIGN PATENT DOCUMENTS

JP 2003-295505 10/2003

OTHER PUBLICATIONS

Patent Abstracts of Japan, JP 11-202551, Jul. 30, 1999.
Patent Abstracts of Japan, JP 9-204062, Aug. 5, 1997.
Patent Abstracts of Japan, JP 2002-014487, Jan. 18, 2002.
U.S. Appl. No. 11/227,191, filed Sep. 16, 2005, Eida.
U.S. Appl. No. 11/228,259, filed Sep. 19, 2005, Eida.
U.S. Appl. No. 11/423,792, filed Jun. 13, 2006, Eida et al.
U.S. Appl. No. 11/102,719, filed Apr. 11, 2005, Eida et al.
U.S. Appl. No. 11/102,745, filed Apr. 11, 2005, Eida et al.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

The present invention relates to a toner for electrostatic image development, obtainable by a process including the steps of (I) melt-kneading a raw material mixture containing a resin binder, a releasing agent, and a colorant; cooling the melt-kneaded mixture; and pulverizing the cooled mixture; and (II) further pulverizing a pulverized product obtained in the step (I) in the presence of an external additive containing at least two kinds of inorganic oxides subjected to hydrophobic treatment, having different average particle sizes from each other; and classifying the pulverized product, wherein the inorganic oxides subjected to hydrophobic treatment in the step (II) have an average particle size of 20 nm or less, and a difference in average particle size of 3 to 10 nm; and a process for preparing the toner. The toner of the present invention can be suitably used, for instance, for the development of a latent image formed in electrophotography, electrostatic recording method, electrostatic printing method or the like.

20 Claims, No Drawings

TONER FOR ELECTROSTATIC IMAGE DEVELOPMENT

FIELD OF THE INVENTION

The present invention relates to a toner for electrostatic image development used, for instance, for the development of a latent image formed in electrophotography, electrostatic recording method, electrostatic printing method or the like, and a process for preparing the same.

BACKGROUND OF THE INVENTION

JP-A-Hei-9-204062 discloses a technique relating to an electrostatic image developer containing a first hydrophobic silica and a second hydrophobic silica, each having a specified average particle size.

JP-A-Hei-11-202551 discloses a technique relating to a process for preparing a color toner including the steps of pulverizing a mixture of a melt-kneaded mixture containing a resin binder, a wax and an organic chromatic colorant with fine inorganic oxide particles, and classifying the resulting pulverized product, whereby the feed of a releasing agent to a heat roller can be made as little as possible, thereby obtaining excellent color fixed images.

SUMMARY OF THE INVENTION

The present invention relates to a toner for electrostatic image development, obtainable by a process including the steps of:

(I) melt-kneading a raw material mixture containing a resin binder, a releasing agent, and a colorant; cooling the melt-kneaded mixture; and pulverizing the cooled mixture; and (II) further pulverizing a pulverized product obtained in the step (I) in the presence of an external additive containing at least two kinds of inorganic oxides subjected to hydrophobic treatment, having different average particle sizes from each other; and classifying the pulverized product, wherein the inorganic oxides subjected to hydrophobic treatment in the step (II) have an average particle size of 20 nm or less, and a difference in average particle size of 3 to 10 nm; and a process for preparing the toner.

DETAILED DESCRIPTION OF THE INVENTION

The present invention relates to a toner for electrostatic image development having excellent filming resistance and stability in image density, and being capable of suppressing background fog not only at the initial stage of printing but also during durability printing even in a high-speed developer device, and a process for preparing such a toner.

According to the present invention, a toner for electrostatic image development having excellent filming resistance and stability in image density, and being capable of suppressing background fog not only at the initial stage of printing but also during durability printing even in a high-speed developer device, and a process for preparing such a toner can be provided.

These and other advantages of the present invention will be apparent from the following description.

In the trends of widespread use of full color printers and miniaturization and speeding up thereof, there are increasing demands for high image qualities and high durability of full color toners. In the miniaturization and speeding up of the developer device, one of the technical objective is to secure stability in fluidity, chargeability or the like of the toner. From this viewpoint, the microgranulation of the external additive for toner has been advanced.

On the other hand, as an external additive for toner, an inorganic oxide having an average particle size in the order of 10 nm or less has been studied, which has been reported to have stabilized charging ability and improve powder properties and transferability (JP-A-Hei-9-204062). However, when the inorganic oxide having a fine particle size as described above is used as an external additive, in the process for preparing a toner including the step of adding and mixing the external additive with the toner before and after the step of classifying the toner, aggregation of the inorganic oxides with themselves may be generated, so that the dispersion and adhesion on the toner surface is lowered.

In the toner of the state described above, the influences of the lowering of dispersion and adhesion of the external additive cannot be neglected in the speeding up of the developer device, and it is especially difficult to secure fluidity and chargeability of the toner in a long-term printing process for large number of times (hereinafter also referred to as during durability printing).

On the other hand, as a means of stabilizing the adhesion of an external additive to a toner, a toner obtainable by properly roughly pulverizing a melt-kneaded mixture containing a resin binder and the like, and mixing the roughly pulverized product with fine inorganic oxide particles has been proposed (JP-A-Hei-11-202551). Therefore, the present inventors have remarked on the technique, and tried to stabilize the adhesion state of the external additive to the toner surface, thereby stabilizing the charging state of the toner. However, it has been found that the toners specifically disclosed in Examples of JP-A-Hei-11-202551 have insufficient image densities and suppression of background fog during the durability printing, in not only a high-speed developer device but also a conventional low-speed developer device.

The present inventors have further made various studies. As a result, they have found a toner obtainable by roughly pulverizing a melt-kneaded mixture of raw materials such as a resin binder, and pulverizing and classifying the roughly pulverized product in the presence of an external additive containing two kinds of inorganic oxides subjected to hydrophobic treatment, having different average particle sizes shows an unexpected state that the dispersion state of the fine inorganic oxide on the toner surface is excellent besides the adhesion stability of the inorganic oxides on the toner surface.

Moreover, the present inventors have found that the toner shows excellent stability beyond expectation in filming resistance and image density, whereby background fogging can be suppressed at the initial stage and during the durability printing in not only a low-speed developer device but also a high-speed developer device.

One of the features of the toner for electrostatic image development resides in that the toner is prepared by a process including the steps of:

(I) melt-kneading a raw material mixture containing a resin binder, a releasing agent, and a colorant; cooling the melt-kneaded mixture; and pulverizing (first-pulverizing) the cooled mixture; and (II) further pulverizing (second-pulverizing) a pulverization product obtained in the step (I) in the presence of an external additive containing at least two kinds of inorganic oxides subjected to hydrophobic treatment, having different average particle sizes from each other, (hereinafter also referred to as "specified inorganic oxides"); and classifying the pulverized product.

The external additive as used in the present invention refers to fine particles other than the toner, which is added in the step after the melt-kneading of the raw material mixture containing a resin binder and the like.

The inorganic oxide usable as the external additive in the present invention is preferably, for instance, an inorganic oxide selected from the group consisting of silica, titania, alumina, zinc oxide, magnesium oxide, cerium oxide, iron oxide, copper oxide and tin oxide. Among them, it is preferable that at least one of the inorganic oxides is silica from the viewpoint of giving chargeability and fluidity.

As the silica, those prepared by a known method can be used. Those prepared by dry method or high-temperature hydrolysis method are preferable from the viewpoint of dispersibility of the silica.

The above-mentioned specified inorganic oxides are inorganic oxides subjected to hydrophobic treatment.

The inorganic oxide subjected to hydrophobic treatment as used herein refers to an inorganic oxide having a degree of hydrophobicity of 40 or more, preferably from 50 to 99, and more preferably from 60 to 98, as determined by a methanol titration method. The determination of the degree of hydrophobicity according to the methanol titration method is more specifically carried out by the following method. Specifically, 0.2 g of an inorganic oxide of which degree of hydrophobicity is to be determined is placed in a glass container having an inner diameter of 7 cm and a capacity of 2 liters or more containing 100 ml of ion-exchanged water, and the mixture is stirred with a magnetic stirrer. The procedures of placing a tip end of a burette containing methanol into the liquid, adding 20 ml of methanol dropwise thereto while stirring, stopping the stirring after 30 seconds, and observing the state after one minute from stopping the stirring are repeatedly carried out. The value obtained by the following formula is calculated when a total amount of methanol when the inorganic oxide no longer floats on the water surface after one minute from stopping the stirring is defined as Y (ml). The determination was made by temperature-controlling water inside the beaker (glass container) to 20°±1° C.

$$\text{Degree of Hydrophobicity}=(Y/(100+Y))\times 100$$

The hydrophobic treatment agent used in the hydrophobic treatment of the inorganic oxide is not particularly limited. The hydrophobic treatment agent for giving negative chargeability includes silane coupling agents such as hexamethyl disilazane (HMDS), dimethyl dichlorosilane (DMDS), isobutyl trimethoxysilane, and octyl silane; silicone oil treatment agents such as dimethyl silicone oil; and the like. In the present invention, it is preferable that at least one of the hydrophobic treatment agents is selected from the silane coupling agents from the viewpoint of reduction in toner aggregation during the pulverizing step in the step (II).

The hydrophobic treatment agent for giving positive chargeability includes aminosilanes; silicone oil treatment agents such as amino-modified silicone oils and epoxy-modified silicone oils; and the like. Among them, the amino-modified silicone oils are preferable from the viewpoint of environmental stability of the triboelectric charges.

In the present invention, at least one of the inorganic oxides subjected to hydrophobic treatment is preferably a negatively chargeable inorganic oxide subjected to hydrophobic treatment, and more preferably a positively chargeable inorganic oxide subjected to hydrophobic treatment is used together therewith. Here, the term "negatively chargeable inorganic oxide" refers to one having a negative triboelectric charge when the inorganic oxide and iron powder is subjected to triboelectric charging, and the term "positively chargeable inorganic oxide" refers to one having a positive triboelectric charge when the inorganic oxide and iron powder is subjected to triboelectric charging. The triboelectric charge of the inorganic oxide is determined with a blowoff-type triboelectric charge measuring apparatus. In the present invention, the triboelectric charge of the negatively chargeable inorganic oxide is preferably from −10 to −500 μC/g, and more preferably from −20 to −400 μC/g. In addition, the triboelectric charge of the positively chargeable inorganic oxide is preferably from 10 to 500 μC/g, and more preferably from 20 to 400 μC/g.

The treated amount of the hydrophobic treatment agent in the inorganic oxide is not particularly limited, as long as the treated amount is in an extent that the desired triboelectric charge and degree of hydrophobicity are obtained. It is preferable that the treated amount per surface area of the inorganic oxide is preferably from 1 to 7 mg/m$^2$.

Supposing that the combination of the hydrophobic treatment agent and the inorganic oxide is listed as "hydrophobic treatment agent-inorganic oxide," the preferred combination in the negatively chargeable inorganic oxide includes hexamethyl disilazane (HMDS)-silica, dimethyl dichlorosilane (DMDS)-silica, silicone oil-silica, a mixture of HMDS and silicone oil-silica, isobutyl trimethoxysilane-titania, silicone-oil-titania, octyl silane-titania, and the like. Among them, HMDS-silica, DMDS-silica, silicone oil-silica, a mixture of HMDS and silicone oil-silica, and isobutyl trimethoxysilane-titania are preferable, HMDS-silica, DMDS-silica, silicone oil-silica, and a mixture of HMDS and silicone oil-silica are more preferable, even more preferably HMDS-silica and DMDS-silica, and even more preferably HMDS-silica.

As the negatively chargeable inorganic oxide subjected to hydrophobic treatment mentioned above, those commercially available can be used.

The preferred commercially available products of HMDS-silica include H3004, H2000, HDK H30TM, HDK H20TM, HDK H13TM, and HDK H05TM (hereinabove commercially available from Wacker Chemicals), TS530 (hereinabove commercially available from Cabot Corporation), RX300, RX200, RX50, and NAX-50 (hereinabove commercially available from Nippon Aerosil) and the like.

The preferred commercially available products of DMDS-silica include R976, R974, and R972 (hereinabove commercially available from Nippon Aerosil) and the like.

The preferred commercially available products of silicone oil-silica include HDK H30TD, HDK H20TD, HDK H13TD, and HDK H05TD (hereinabove commercially available from Wacker Chemicals), TS720 (hereinabove commercially available from Cabot Corporation), RY-50 and NY-50 (hereinabove commercially available from Nippon Aerosil), and the like.

The preferred commercially available products of a mixture of HMDS and silicone oil-silica include HDK H30TX, HDK H20TX, HDK H13TX, HDK H05TX (hereinabove commercially available from Wacker Chemicals), and the like.

The preferred commercially available products of isobutyl trimethoxysilane-titania include JMT-150IB (hereinabove commercially available from Tayca, and the like.

On the other hand, the preferred combination in the positively chargeable inorganic oxide includes amino-modified silicone oil-silica, aminosilane-silica, epoxy-modified silicone oil-silica and the like. The amino-modified silicone oil-silica is more preferable.

As the positively chargeable inorganic oxide subjected to hydrophobic treatment mentioned above, those commercially available can be used.

The preferred commercially available products of amino-modified silicone oil-silica include HVK2150, HDK3050, HDK H30TA, HDK H13TA, HDK H05TA (commercially available from Wacker Chemicals) and the like.

It is preferable that at least one of the specified inorganic oxides is a hydrophobic silica. For instance, the preferred combination of the negatively chargeable inorganic oxide and the positively chargeable inorganic oxide [negatively chargeable inorganic oxide/positively chargeable inorganic oxide] is one that contains HMDS-silica/amino-modified silicone oil-silica or DMDS-silica/amino-modified silicone oil-silica, and more preferably one that contains DMDS-silica/amino-modified silicone oil-silica.

The average particle size of the specified inorganic oxides is required to be 20 nm or less, preferably 16 nm or less, from the viewpoint of fluidity and triboelectric charging stability of the toner in a high-speed developer device. The average particle size of the specified inorganic oxides is preferably 4 nm or more, and more preferably 8 nm or more, from the viewpoint of dispersion and adhesion of the specified inorganic oxides to the toner surface. The average particle size of the specified inorganic oxides is preferably from 4 to 20 nm, and more preferably from 8 to 16 nm, from the overall viewpoint. In the present invention, the average particle size of the inorganic oxide refers to a number-average particle size, which is an average taken from particle sizes of 500 particles determined from a photograph taken with a scanning electron microscope (SEM) of the inorganic oxide.

The specified inorganic oxides have an average particle size within the above-mentioned range and contain at least two inorganic oxides subjected to hydrophobic treatment, having a difference in average particle sizes of from 3 to 10 nm, preferably from 4 to 8 nm, from the viewpoint of satisfying fluidity and triboelectric charging stability of the toner in a high-speed developer device, and dispersion and adhesion of the specified inorganic oxides to the toner surface.

Of the two kinds of the inorganic oxides subjected to hydrophobic treatment, the average particle size of the specified inorganic oxide having a smaller average particle size (hereinafter also referred to as "inorganic oxide S") is preferably from 4 to 16 nm, and more preferably from 6 to 12 nm, from the viewpoint of fluidity and triboelectric charging stability of the toner in a high-speed developer device. The average particle size of the specified inorganic oxide having a larger average particle size (hereinafter also referred to as "inorganic oxide L") is preferably from 10 to 20 nm, and more preferably from 12 to 18 nm, from the viewpoint of dispersion and adhesion of the specified inorganic oxides to the toner surface. The average particle size of the combination (inorganic oxide S/inorganic oxide L) is preferably 4 to 16 nm/10 to 20 nm, and more preferably 6 to 12 nm/12 to 18 nm, from the overall viewpoint.

The weight ratio of the inorganic oxide S to the inorganic oxide L (inorganic oxide S/inorganic oxide L) is preferably from 95/5 to 5/95, more preferably from 90/10 to 20/80, and even more preferably from 80/20 to 40/60.

When the specified inorganic oxides contain a negatively chargeable inorganic oxide and a positively chargeable inorganic oxide, it is preferable that the inorganic oxide S is the positively chargeable inorganic oxide, and that the inorganic oxide L is the negatively chargeable inorganic oxide.

The formulation amount of the specified inorganic oxides in terms of a total amount of the specified inorganic oxides is preferably from 0.1 to 10 parts by weight, and more preferably from 0.5 to 5 parts by weight, based on 100 parts by weight of the pulverized product obtained in the step (I), from the viewpoint of environmental stability.

In the external additive which is present during the step (II) may contain fine particles other than the above-mentioned specified inorganic oxides, for instance, an inorganic oxide having an average particle size larger than the specified inorganic oxides, an inorganic oxide not subjected to hydrophobic treatment or resin fine particles within the range which would not hinder the effects by the specified inorganic oxides. However, the content of the specified inorganic oxides in the external additive used in the step (II) is preferably from 50 to 100% by weight, more preferably from 70 to 100% by weight, even more preferably from 90 to 100% by weight, and even more preferably from 100% by weight.

The toner of the present invention can be prepared by a process including the step of:

(I) melt-kneading a raw material mixture; cooling the melt-kneaded mixture; and pulverizing (first-pulverizing) the cooled mixture; and (II) further pulverizing (second-pulverizing) the pulverized product obtained in the step (I) in the presence of an external additive containing specified inorganic oxides; and classifying the pulverized product.

In the step (I), as the raw material mixture to be melt-kneaded, there is used raw material mixture containing a resin binder, a releasing agent and a colorant.

The resin binder in the present invention includes polyesters, vinyl resins such as styrene-acrylic resins, epoxy resins, polycarbonates, polyurethanes, hybrid resins containing two or more resin components, and the like. Among them, from the viewpoint of low-temperature fixing ability and transparency, the polyester and the hybrid resin are preferable, and the polyester is more preferable. The content of the polyester is preferably 50% by weight or more, more preferably 65% by weight or more, even more preferably 80% by weight or more, even more preferably 90% by weight or more, and even more preferably 100% by weight, of the resin binder, from the viewpoint of low-temperature fixing ability and transparency.

As the raw material monomers for the polyester, an alcohol component containing dihydric or higher polyhydric alcohols, and a carboxylic acid component containing dicarboxylic or higher polycarboxylic acid compounds such as dicarboxylic or higher polycarboxylic acids, acid anhydrides thereof and esters thereof.

The alcohol component includes dihydric alcohols such as an alkylene (2 or 3 carbon atoms) oxide (average number of moles: 1 to 16) adduct of bisphenol A, such as polyoxypropylene(2.2)-2,2-bis(4-hydroxyphenyl)propane and polyoxyethylene(2.2)-2,2-bis(4-hydroxyphenyl)propane, ethylene glycol, and propylene glycol; and the trihydric or higher polyhydric alcohols such as glycerol and pentaerythritol.

In addition, the carboxylic acid component includes dicarboxylic acids such as phthalic acid, isophthalic acid, terephthalic acid, fumaric acid, maleic acid, a substituted succinic acid of which substituent is an alkyl group having 1 to 20 carbon atoms or an alkenyl group having 2 to 20 carbon atoms, such as dodecenylsuccinic acid or octylsuccinic acid; and tricarboxylic or higher polycarboxylic acids such as 1,2,4-benzenetricarboxylic acid (trimellitic acid) and pyromellitic acid; acid anhydrides thereof, alkyl (1 to 8 carbon atoms) esters thereof, and the like.

Further, the alcohol component and the carboxylic acid component may properly contain a monohydric alcohol and a monocarboxylic acid, from the viewpoint of adjusting the molecular weight or the like.

The polyester can be prepared by, for instance, polycondensation of the alcohol component and the carboxylic acid component at a temperature of from 180° to 250° C. in an inert gas atmosphere, in the presence of an esterification catalyst as desired.

The polyester has an acid value of preferably from 0.5 to 60 mg KOH/g, from the viewpoint of the dispersibility of the colorant and chargeability of the toner, and a hydroxyl value of from 1 to 60 mg KOH/g.

In addition, the polyester has a softening point of preferably from 80° to 165° C., and a glass transition temperature of preferably from 50° to 90° C.

In the present invention, the hybrid resin is preferably a resin in which two or more resin components are partially chemically bonded to each other. The hybrid resin may be obtained by using two or more resins as raw materials, or the hybrid resin may be obtained by using a mixture of one resin and raw material monomers for the other resin, or also a mixture of raw material monomers for two or more resins. In order to efficiently obtain a hybrid resin, those obtained from a mixture of raw material monomers of raw material monomers for two or more resins are preferable.

Therefore, it is preferable that the hybrid resin is obtained by mixing raw material monomers for two polymerization resins each having independent reaction paths, preferably raw material monomers for the polyester and raw material monomers for the vinyl resin, and carrying out the two polymerization reactions. Specifically, the hybrid resin disclosed in JP-A-Hei-10-087839 (U.S. Pat. No. 5,908,727) is preferable.

Further, the raw material mixture used in the melt-kneading contains a releasing agent, from the viewpoint of stable adhesion of the external additive on the toner surface in the step (II). As the releasing agent, a wax having a melting point of from 65° to 150° C. is preferable, and the term "wax" generally refers to a wax as described in "Iwanami Rikagaku Jiten (Iwanami Physicochemical Dictionary)," Fourth Edition, p. 1407.

The releasing agent in the present invention includes, for instance, synthetic waxes such as polypropylene wax, polyethylene wax and Fischer-Tropsch wax; coal waxes such as montan wax; alcohol waxes; petroleum waxes such as paraffin waxes; waxes containing hydroxy acid ester; and the like. Among them, when the polyester is used as a resin binder, it is preferable that the wax is polypropylene wax and the wax containing hydroxy acid ester, from the viewpoint of dispersibility of the wax into the polyester.

The wax containing hydroxy acid ester includes natural waxes such as carnauba wax and rice wax; synthetic wax containing hydroxy acid ester, such as ceryl-ω-hydroxycerotate, ceryl-ω-hydroxymelissate, and myricyl-ω-hydroxymelissate; and the like. The natural waxes are more preferable, from the viewpoint of securing offset resistance in an even wider temperature range, and carnauba wax is even more preferable.

The content of the releasing agent is preferably 0.5 parts by weight or more, more preferably from 1 to 20 parts by weight, and even more preferably from 1 to 15 parts by weight, based on 100 parts by weight of the resin binder, from the viewpoints of offset resistance and durability.

As the colorants in the present invention, all of the dyes, pigments and the like which are used as colorants for toners can be used. The colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner of the present invention may be any of black toners, color toners and full-color toners. The amount of the colorant used is preferably from 1 to 40 parts by weight, and more preferably from 3 to 10 parts by weight, based on 100 parts by weight of the resin binder.

In the toner of the present invention, additives such as charge control agents, fluidity improvers, electric conductivity modifiers, extenders, reinforcing fillers such as fibrous substances, antioxidants, anti-aging agents, and cleanability improvers may be appropriately added.

The melt-kneading of the raw material mixture can be carried out by, for instance, a closed type kneader, a closed type single-screw or twin-screw extruder, an open-roller type kneader and the like. In the present invention, it is preferable to use an open-roller type kneader, from the viewpoint of improving dot reproducibility during durability printing of the toner. By the use of the open-roller type kneader, the dispersion of the releasing agent in the resin binder is accelerated, so that it is presumed that the adhesion state of the specified inorganic oxides to the toner is further stabilized. Incidentally, the temperature of the melt-kneading is not particularly limited as long as each of the raw material mixture is sufficiently miscible with each other. It is preferable that the temperature of the melt-kneading is usually from 80° to 140° C.

The open-roller type kneader in the present invention refers to a kneader containing at least two rollers, and a melt-kneading member is an open type, and it is preferable that at least two of the rollers are a heat roller and a cooling roller. The open-roller type kneader can easily dissipate the kneading heat generated during the melt-kneading. In addition, it is preferable that the open-roller type kneader is a continuous type kneader, from the viewpoint of production efficiency.

Further, in the above-mentioned open-roller type kneader, two of the rollers are arranged in parallel closely to each other, and the gap between the rollers is preferably from 0.01 to 5 mm, and more preferably from 0.05 to 2 mm. In addition, structures, sizes, materials and the like of the roller are not particularly limited. Also, the roller surface may be any of smooth, wavy, rugged or other surfaces.

The number of rotation of the roller, i.e. the peripheral speed of the roller, is preferably from 2 to 100 m/min. The peripheral speed of the cooling roller is preferably from 2 to 100 m/min, more preferably from 10 to 60 m/min, and even more preferably from 15 to 50 m/min. In addition, it is preferable that the two rollers have different peripheral speeds from each other, and that the ratio of the peripheral speed of the two rollers (cooling roller/heat roller) is preferably from 1/10 to 9/10, and more preferably from 3/10 to 8/10.

In order that the kneaded product is easily adhered to the heat roller, it is preferable that the temperature of the heat roller is adjusted to be higher than both the temperatures of the softening point of the resin binder and the melting point of the wax, and that the temperature of the cooling roller is adjusted to be lower than both the temperatures of the softening point of the resin binder and the melting point of the wax.

The difference in temperature between the heat roller and the cooling roller is preferably from 60° to 150° C., and more preferably from 80° to 120° C.

Here, the temperature of the roller can be adjusted by a heating medium passing through the inner portion of the roller, and each roller may be divided in two or more portions in the inner portion of the roller, each being connected to heating media of different temperatures.

It is preferable that the temperature of the heat roller, especially the raw material feeding side of the heat roller is adjusted to be higher than both the softening point of the resin binder and the melting point of the wax, more preferably higher than the higher of the softening point of the resin binder and the melting point of the wax by 0° to 80° C., and even more preferably by 5° to 50° C. It is preferable that the temperature of the cooling roller is adjusted to be lower than both of the softening point of the resin binder and the melting point of the wax, more preferably lower than the lower of the softening point of the resin binder and the melting point of the wax by 0° to 80° C., and even more preferably by 40° to 80° C.

Next, the resulting kneaded mixture is cooled to a pulverizable hardness, and subjected to a pulverization (a first pulverization). In the present invention, the first pulverization is a rough pulverization. In this pulverization, the kneaded mixture is pulverized to a size so that the average particle size of the resulting pulverized product (roughly pulverized product) is preferably from 0.03 to 4 mm, more preferably from 0.05 to 2 mm, and even more preferably the above-mentioned average particle size, and a maximum particle size of 5 mm or less, even more preferably the above-mentioned average particle size, and a maximum particle size of 3 mm or less, and even more preferably the average particle size of from 0.05 to 2 mm and the maximum particle size of 3 mm or less.

Here, the average particle size of the roughly pulverized product refers to an average of the maximum length of the projected area when the product is observed with a microscope, and the phrase "the maximum particle size of 5 mm or less" means all of the toner particles pass through a sieve of which sieve opening is 5 mm.

The pulverizer usable in the rough pulverization includes atomizer, Rotoplex, and the like.

In the present invention, in the subsequent step (II), the roughly pulverized product is pulverized (second pulverization) in the presence of an external additive containing specified inorganic oxides, whereby the filming resistance of the finally obtained toner can be even more improved. Such an improvement is presumably due to the fact that the specified inorganic oxides on the toner surface is even more uniformly dispersed and adhered, as compared to a usual method of externally adding an inorganic oxide in the final step of the toner preparation.

In the step (II), when the roughly pulverized product is pulverized in the presence of an external additive containing the specified inorganic oxides, it is preferable that the roughly pulverized product is mixed with the above-mentioned external additive containing the specified inorganic oxides, and further pulverized, from the viewpoint of further increasing effects for dot reproducibility.

In the mixing of the roughly pulverized product with the external additive in the step (II), it is preferable to use an agitator containing an agitation member such as rotating impeller, from the viewpoint of uniform dispersion of a specified external additive. The number and shape of the rotating impeller may be properly designed according to the scale of the agitator, and it is preferable to use two or more agitation impellers in an agitator. The agitation member is preferably positioned at an upper portion of the mixing member, from the viewpoint of continuous treatment of the pulverized product.

The mixing conditions for the roughly pulverized product with the external additive to be present during the step (II) are not particularly limited, as long as both the components can be sufficiently mixed, and can be properly determined according to the scale of the agitator. When an agitator of a batch-process having a capacity of about 10 liters is used, it is preferable that the mixing is carried out at a rotational speed of from 2000 to 5000 r/min for 30 seconds to 2 minutes or so. In addition, when an agitator of a continuous-process having a capacity of about 5 liters is used, it is preferable that the mixing is carried out at a residence time of from 1 to 60 seconds.

In the present invention, the more sufficiently the roughly pulverized product and the external additive are agitated, the more excellent the dot reproducibility during the durability printing of the toner. As a specific measure, it is preferable that the mixing is carried out until the aggregate of the inorganic oxide is not visually confirmed, and further that the external additive is uniformly dispersed when the roughly pulverized product is observed with a scanning electron microscope (SEM).

In the step (II), when the roughly pulverized product is further pulverized in the presence of the external additive, there can be used a jet mill such as impact type mill; rotary mechanical mill or the like. In the present invention, the jet mill is preferable, from the viewpoint of adhesion stability of the inorganic oxide on the toner surface, and more preferably impact type mill.

The air pressure upon pulverizing when using a jet mill, specifically the pressure of pulverization air introduced into the pulverization nozzle is preferably from 0.2 to 1 MPa, more preferably from 0.3 to 0.8 MPa, and even more preferably from 0.4 to 0.7 MPa.

In the present invention, in order to continuously produce on an industrial scale, it is preferable that the processes from the mixing of the roughly pulverized product with the external additive to the pulverization (a second pulverization) are continuously carried out, i.e. the roughly pulverized product and the external additive are subjected to continuous mixing, and the resulting mixture is continuously subjected the second pulverization.

The pulverized product obtained by the second pulverization (finely pulverized product) has a volume-average particle size ($D_{50}$) of preferably 15 μm or less, more preferably from 3 to 10 μm, and even more preferably from 3 to 8 μm.

By classifying the finely pulverized product, the toner can be obtained. The classifier usable in the classification includes air classifiers, rotor type classifiers, sieve classifiers, and the like.

The toner has a volume-average particle size ($D_{50}$) of preferably from 3.5 to 11 μm or less, more preferably from 3.5 to 9 μm, and even more preferably from 4 to 8 μm.

The toner of the present invention may be those obtainable by a process further including the step, subsequent to the step (II), of:

(III) mixing an external additive such as the specified inorganic oxides usable in the step (II), the other inorganic oxide such as silica, and resin fine particles composed of polytetrafluoroethylene or the like.

The external additive usable in the step (III) is preferably an inorganic oxide from the viewpoint of giving fluidity. Also, the external additive has an average particle size of preferably 25 nm or more, more preferably 30 nm or more, and even more preferably 35 nm or more, from the viewpoint of preventing embedment into the toner surface, and the external additive has an average particle size of preferably 100 nm or less, more preferably 80 nm or less, and even more preferably 60 nm or less, from the viewpoint of adhesion to the toner surface. The external additive has an average particle size of preferably from 25 to 100 nm, more preferably from 30 to 80 nm, and even more preferably from 35 to 60 nm, from the overall viewpoint. Even more preferably, the average particle size is larger than the average particle size of the external additive to be present during the step (II).

In the mixing of the finely pulverized product or the toner particles obtained after the classifying step with an external additive, it is preferable to use an agitator having an agitation member such as rotary impeller, and an even more preferred agitator includes a Henschel mixer.

The toner of the present invention can exhibit excellent properties in image density, filming resistance and suppression of background fog even in durability printing with not only a low-speed developer device but also a high-speed developer device. Therefore, the effects of the present invention can be more remarkably exhibited by applying the toner of the present invention to a high-speed developer device which has a printing speed of preferably 60 mm/second or more.

The toner of the present invention can be used without particular limitation in any of the development method alone as a developer in the case where fine magnetic material powder is contained, or as a nonmagnetic monocomponent developer or as a two-component developer by mixing the toner with a carrier in the case where fine magnetic material powder is not contained. The toner of the present invention can be even more suitably used as a toner for nonmagnetic monocomponent development, from the viewpoint obtaining high image quality.

EXAMPLES

The following examples further describe and demonstrate embodiments of the present invention. The examples are given solely for the purposes of illustration and are not to be construed as limitations of the present invention.

[Melting Point of Wax]

A maximum peak temperature for heat of fusion is determined with a sample using a differential scanning calorimeter (DSC 210, manufactured by Seiko Instruments, Inc.), when the sample is treated by raising its temperature to 200° C., cooling the sample at a cooling rate of 10° C./min. to 0° C., and thereafter heating the sample at a heating rate of 10° C./min. Here, the maximum peak temperature is defined as a melting point of a wax.

[Triboelectric Charges of Inorganic Oxide]

The amount 0.01 g of an inorganic oxide and 9.99 g of iron powder carrier having a particle size of from 100 to 200 mesh (sieve opening: 85 to 200 μm) are weighed and placed in a 20 ml glass bottle, and the mixture is stirred at 250 r/min with a ball-mill for 10 minutes, to prepare a sample.

The triboelectric charges of the prepared sample are measured by a blow-off type electric charge measuring device equipped with a Faraday cage, a capacitor and an electrometer. Specifically, W (g) of the prepared sample is placed into a brass measurement cell equipped with a stainless screen of 400 mesh (sieve opening: 30 μm). Next, after aspirating from a suction opening for 5 seconds, blowing is carried out for 5 seconds under a pressure indicated by a barometric regulator of 0.6 kgf/m$^2$, thereby selectively removing only the inorganic oxide from the cell.

In this case, the voltage of the electrometer after 2 seconds from the start of blowing is defined as V (volt). Here, when the electric capacitance of the capacitor is defined as C (μF), the triboelectric charge of the inorganic oxide is calculated by the following equation:

$$\text{Triboelectric charges } (\mu C/g) = (C \times V)/0.001\ W.$$

[Volume-Average Particle Size ($D_{50}$) of Toner and Finely Pulverized Product]

Measuring Apparatus: Coulter Multisizer II (commercially available from Beckman Coulter)

Aperture Diameter: 100 μm

Range of Determined Particle Size: 2 to 60 μm

Analyzing Software: Coulter Multisizer AccuComp Ver. 1.19 (commercially available from Beckman Coulter)

Electrolyte: Isotone II (commercially available from Beckman Coulter)

Dispersion: 5% electrolyte of EMULGEN 109P (commercially available from Kao Corporation, polyoxyethylene lauryl ether, HLB: 13.6)

Dispersing Conditions: Ten milligrams of a test sample is added to 5 ml of a dispersion, and the resulting mixture is dispersed in an ultrasonic disperser for 1 minute. Thereafter, 25 ml of an electrolyte is added to the dispersion, and the resulting mixture is dispersed in an ultrasonic dispersing apparatus for another 1 minute.

Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds, to obtain a volume-average particle size ($D_{50}$) from its particle size distribution.

Resin Preparation Example 1

The amount 714 g of polyoxypropylene(2.2)-2,2-bis(4-hydroxyphenyl)propane, 663 g of polyoxyethylene(2.2)-2,2-bis(4-hydroxyphenyl)propane, 518 g of isophthalic acid, 70 g of isooctenylsuccinic acid, 80 g of trimellitic acid and 2 g of dibutyltin oxide were reacted while stirring at 210° C. under a nitrogen gas atmosphere until the softening point as determined by ASTM D36-86 reached 120° C., to give a resin A.

Examples 1 to 5, and 7 and Comparative Examples 1 to 4

One-hundred parts by weight of the resin A, 3 parts by weight of a blue colorant (Pigment Blue 15:3), 1 part by weight of polypropylene wax "NP-105" (commercially available from MITSUI CHEMICALS, INC., melting point: 140° C.), and 1 part by weight of a negatively chargeable charge control agent "BONTRON E-84" (commercially available from Orient Chemical Co., Ltd.) were supplied into a Henschel mixer, and the mixture was mixed at a mixer temperature of 40° C. for 2 minutes, while stirring, to give a raw material mixture. The resulting raw material mixture was melt-kneaded with a continuous-type twin-screw kneader at 100° C., to give a kneaded mixture. The resulting kneaded mixture was cooled in the air, and roughly pulverized with an atomizer (commercially available from Tokyo Atomizer Manufacturing), and the roughly pulverized product was passed through a sieve having a sieve opening of 2 mm, to give a roughly pulverized product having a maximum diameter of 2 mm or less. One-hundred parts by weight of the resulting roughly pulverized product and an external additive a shown in Table 1 were mixed with a Henschel mixer for 1 minute. The roughly pulverized product adhered with an external additive a was finely pulverized with a jet mill pulverizer (commercially available from Nippon Pneumatic Mfg. Co., Ltd.) of which air pressure during the pulverization was adjusted to 0.5 MPa, and the finely pulverized product was further classified, to give a toner having a volume-average particle size ($D_{50}$) of 7.0 μm.

In Example 5 and Comparative Examples 3 and 4, an external additive b shown in Table 1 was further added to 100 parts by weight of the toner particles, and the mixture was mixed with a Henschel mixer for 2 minutes.

Example 6

The same procedures as in Example 5 were carried out except that the raw materials as shown in Table 1 were melt-kneaded with a continuous twin open-roller type kneader "Kneadex" (commercially available from MITSUI MINING COMPANY, LIMITED) in place of the continuous twin-screw type kneader, to give a toner.

Incidentally, the continuous twin open-roller type kneader used has a roller having an outer diameter of 0.14 m and an effective length of 0.8 m, and the operating conditions are a rotational speed of a higher rotation side roller (front roller) of 75 r/min, a rotational speed of a lower rotation side roller (back roller) of 50 r/min, and a gap between the rollers of 0.1 mm. The temperature of the heating medium and the cooling medium inside the rollers are as follows. The higher rotation side roller has a temperature at the raw material supplying side of 150° C., and a temperature at the kneaded mixture discharging side of 130° C., and the lower rotation side roller has a temperature at the raw material supplying side of 35° C., and a temperature at the kneaded mixture discharging side of 30° C. In addition, the feeding rate of the raw material mixture was 5 kg/hour, and the average residence time of about 5 minutes.

Incidentally, all the degrees of hydrophobicity of the external additives used in Examples and Comparative Examples were 60 or more.

Test Example

A toner was loaded to a printer "MicroLine 9300PS" (commercially available from Oki Data Corporation, resolution: 1200 dpi×600 dpi, printing speed: 30 ppm (A4 paper sheets fed in width direction, 150 mm/second). Blank sheets (printing ratio: 0%) were printed under environmental conditions of a temperature of 35° C. and relative humidity of 80%. Thereafter, a toner on a photoconductor drum was transferred to a mending tape, and its hue was determined. The difference in hue with the blank sheet (ΔE) was determined, and initial background fog was evaluated in accordance with the following evaluation criteria.

Further, after fixed images having a printing ratio of 5% were continuously printed for 12,000 sheets, blank sheets (printing ratio: 0%) were again printed under environmental conditions of a temperature of 35° C. and relative humidity of 80% at a point of printing 6,000 sheets and at a point of printing 12,000 sheets, and the background fog after the durability printing was evaluated in the same manner as in the initial background fog. Here, the hue was determined according to L*a*b* with "X-rite Model 938" (commercially available from X-rite, aperture: 4 mm, light source C, angle of scope: 2°).

Moreover, the toner on the developer roller at a point of printing 6,000 sheets and at a point of printing 12,000 sheets was transferred to a mending tape, and whether or not lines are generated due to filming was visually examined. The filming resistance was evaluated in accordance with the following evaluation criteria. The results are shown in Table 1.

[Evaluation Criteria for Background Fog]

◎: The ΔE is less than 1.0.

○: The ΔE is 1.0 or more and less than 2.0.

Δ: The ΔE is 2.0 or more and less than 3.0.

X: The ΔE is 3.0 or more.

[Evaluation Criteria for Filming Resistance]

◎: No lines or unevenness are generated, thereby giving a very uniform image.

○: No lines or unevenness are generated, thereby giving an almost uniform image.

Δ: The lines are not generated, but unevenness in image density is partly found.

X: Two or less lines are generated.

XX: Three or more lines are generated.

TABLE 1

| | External Additive a | | | | | | External Additive b | Initial | After 6000 Sheets of Durable Printing | | After 12000 Sheets of Durable Printing | |
|---|---|---|---|---|---|---|---|---|---|---|---|---|
| | Inorganic Oxide L | Chargeability | Average Particle Size | Inorganic Oxide S | Chargeability | Average Particle Size | | Background Fog | Background Fog | Filming Resistance | Background Fog | Filming Resistance |
| Ex. 1 | HVK2150/1.0 | positive | 12 nm | HDK H30TA/0.5 | positive | 8 nm | — | Δ | Δ | ○ | Δ | ○ |
| Ex. 2 | HDK H20TD/1.0 | negative | 12 nm | HDK H30TA/0.5 | positive | 8 nm | — | ○ | Δ | ○ | Δ | ○ |
| Ex. 3 | R972/1.0 | negative | 16 nm | HVK2150/0.5 | positive | 12 nm | — | ◎ | ○ | ○ | ○ | ○ |
| Ex. 4 | R972/1.0 | negative | 16 nm | H3004/0.5 | negative | 8 nm | — | ○ | ○ | ◎ | ○ | ◎ |
| Ex. 5 | R972/1.0 | negative | 16 nm | H3004/0.5 | negative | 8 nm | RY-50/0.5 | ◎ | ◎ | ◎ | ○ | ◎ |
| Ex. 6 | R972/1.0 | negative | 16 nm | H3004/0.5 | negative | 8 nm | RY-50/0.5 | ◎ | ◎ | ◎ | ◎ | ◎ |
| Ex. 7 | JMT150IB/1.0 | negative | 15 nm | H3004/0.5 | negative | 8 nm | — | ○ | ○ | ◎ | Δ | ○ |
| Comp. Ex. 1 | RY-50/1.0 | negative | 40 nm | H3004/0.5 | negative | 8 nm | — | ○ | Δ | Δ | X | X |
| Comp. Ex. 2 | HDK H20TD/1.0<br>HDK H20TM/0.5 | negative | 12 nm<br>12 nm | — | — | — | — | ○ | ○ | Δ | Δ | X |
| Comp. Ex. 3 | R972/1.0 | negative | 16 nm | — | — | — | H3004/0.3 | Δ | X | Δ | X | X |

TABLE 1-continued

| | External Additive a | | | | | | External Additive b | Initial | After 6000 Sheets of Durable Printing | | After 12000 Sheets of Durable Printing | |
|---|---|---|---|---|---|---|---|---|---|---|---|---|
| | Inorganic Oxide L | Chargeability | Average Particle Size | Inorganic Oxide S | Chargeability | Average Particle Size | | Background Fog | Background Fog | Filming Resistance | Background Fog | Filming Resistance |
| Comp. Ex. 4 | — | — | — | — | — | — | R972/0.5 HVK2150/0.3 | Δ | Δ | X | X | XX |

Note 1)
The amount of the external additive is expressed by parts by weight.
Note 2)
The raw material mixture was melt-kneaded with a continuous twin open-roller type kneader only in Example 6.
Note 3)
HVK2150: commercially available from Wacker Chemicals, positively chargeable, +150 μC/g, amino-modified silicone oil-silica, average particle size: 12 nm
HDK H20TD: commercially available from Wacker Chemicals, negatively chargeable, −200 μC/g, silicone oil-silica, average particle size: 12 nm
R972: commercially available from Nippon Aerosil, negatively chargeable, −380 μC/g, DMDS-silica, average particle size: 16 nm
JMT150IB: commercially available from Tayca, negatively chargeable, −30 μC/g, isobutyl trimethoxysilane-titania, average particle size: 15 nm
RY-50: commercially available from Nippon Aerosil, negatively chargeable, −50 μC/g, silicone oil-silica, average particle size: 40 nm
HDK H20TM: commercially available from Wacker Chemicals, negatively chargeable, −300 μC/g, HMDS-silica, average particle size: 12 nm
HDK H30TA: commercially available from Wacker Chemicals, positively chargeable, +200 μC/g, amino-modified silicone oil-silica, average particle size: 8 nm
H3004: commercially available from Wacker Chemicals, negatively chargeable, −420 μC/g, HMDS-silica, average particle size: 8 nm It can be seen from the above results that the toners of the Examples have little background fog and excellent filming resistance even after durable printing, as compared to those of the toners of Comparative Examples.

The toner for electrostatic image development of the present invention can be suitably used, for instance, for the development of a latent image formed in electrophotography, electrostatic recording method, electrostatic printing method or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development, obtainable by a process comprising the steps of:

(I) melt-kneading a raw material mixture comprising a resin binder, a releasing agent, and a colorant; cooling the melt-kneaded mixture; and pulverizing the cooled mixture; and (II) further pulverizing a pulverized product obtained in the step (I) in the presence of an external additive comprising at least two kinds of inorganic oxides subjected to hydrophobic treatment, having different average particle sizes from each other; and classifying the pulverized product, wherein the inorganic oxides subjected to hydrophobic treatment in the step (II) have an average particle size of 20 nm or less, and a difference in average particle size of 3 to 10 nm.

2. The toner according to claim 1, wherein the step (II) comprises mixing the pulverized product obtained in the step (I) with the external additive, and further pulverizing the resulting mixture, and classifying the pulverized product.

3. The toner according to claim 1, wherein the external additive comprises an inorganic oxide subjected to hydrophobic treatment, having an average particle size of from 10 to 20 nm, and an inorganic oxide subjected to hydrophobic treatment, having an average particle size of from 4 to 16 nm.

4. The toner according to claim 1, wherein at least one of the inorganic oxides subjected to hydrophobic treatment is a hydrophobic silica.

5. The toner according to claim 1, wherein at least one of the inorganic oxides subjected to hydrophobic treatment is a negatively chargeable inorganic oxide subjected to hydrophobic treatment.

6. The toner according to claim 1, obtainable by a process further comprising, subsequent to the step (II), the step of:

(III) mixing the product obtained in the step (II) with an external additive.

7. The toner according to claim 6, wherein the external additive used in the step (III) is an inorganic oxide having an average particle size of from 25 to 100 nm.

8. The toner according to claim 1, wherein the melt-kneading of the raw material mixture in the step (I) is carried out with an open-roller type kneader.

9. The toner according to claim 1, wherein the toner has a volume-average particle size ($D_{50}$) of from 3.5 to 9 μm.

10. A process for preparing a toner for electrostatic image development, comprising the steps of:

(I) melt-kneading a raw material mixture comprising a resin binder, a releasing agent, and a colorant; cooling the melt-kneaded mixture; and pulverizing the cooled mixture; and (II) further pulverizing a pulverized product obtained in the step (I) in the presence of an external additive comprising at least two kinds of inorganic oxides subjected to hydrophobic treatment, having different average particle sizes from each other; and classifying the pulverized product, wherein the inorganic oxides subjected to hydrophobic treatment in the step (II) have an average particle size of 20 nm or less, and a difference in average particle size of 3 to 10 nm.

11. The process according to claim 10, wherein the step (II) comprises mixing the pulverized product obtained in the step (I) with the external additive, and further pulverizing the resulting mixture, and classifying the pulverized product.

12. The process according to claim 10, wherein the pulverizing step in the step (II) is carried out with a jet mill having an air pressure during pulverization of from 0.2 to 1 MPa.

13. The process according to claim 10, wherein the melt-kneading of the raw material mixture in the step (I) is carried out with an open-roller type kneader.

14. The process according to claim 10, wherein the external additive comprises an inorganic oxide subjected to hydrophobic treatment, having an average particle size of from 10 to 20 nm, and an inorganic oxide subjected to hydrophobic treatment, having an average particle size of from 4 to 16 nm.

15. The process according to claim 10, wherein at least one of the inorganic oxides subjected to hydrophobic treatment is a hydrophobic silica.

16. The process according to claim 10, wherein at least one of the inorganic oxides subjected to hydrophobic treatment is a negatively chargeable inorganic oxide subjected to hydrophobic treatment.

17. The process according to claim 10, further comprising, subsequent to the step (II), the step of:

(III) mixing the product obtained in the step (II) with an external additive.

18. The process according to claim 17, wherein the external additive used in the step (III) is an inorganic oxide having an average particle size of from 25 to 100 nm.

19. The process according to claim 10, wherein the toner has a volume-average particle size ($D_{50}$) of from 3.5 to 9 μm.

20. The process according to claim 10, wherein the pulverized product obtained in the step (I) has an average particle size of from 0.03 to 4 mm.

* * * * *